US007712515B2

(12) United States Patent
Sulak et al.

(10) Patent No.: US 7,712,515 B2
(45) Date of Patent: May 11, 2010

(54) MUNICIPAL CASTING FRAME AND METHOD OF MANUFACTURING SAME

(75) Inventors: Leon P. Sulak, Boyne City, MI (US); Brian J. Rachwitz, East Jordan, MI (US); Keith A. Gee, East Jordan, MI (US); Paul F. Harm, East Jordan, MI (US); Jeremy I. Johnson, East Jordan, MI (US)

(73) Assignee: East Jordan Iron Works, Inc., East Jordan, MI (US)

( * ) Notice: Subject to any disclaimer, the term of this patent is extended or adjusted under 35 U.S.C. 154(b) by 927 days.

(21) Appl. No.: 11/279,132

(22) Filed: Apr. 10, 2006

(65) Prior Publication Data

US 2007/0237580 A1 Oct. 11, 2007

(51) Int. Cl.
*B22C 7/00* (2006.01)

(52) U.S. Cl. ..... 164/222; 404/25; 411/177

(58) Field of Classification Search ..... 404/25, 404/26; 52/19, 20; 411/177, 180, 339; 49/49; 164/222

See application file for complete search history.

(56) References Cited

U.S. PATENT DOCUMENTS

| | | | | |
|---|---|---|---|---|
| 1,596,815 | A * | 8/1926 | Dooley et al. | 164/222 |
| 4,177,229 | A * | 12/1979 | Moore | 264/40.5 |
| 4,652,023 | A * | 3/1987 | Timmons | 285/93 |
| 4,723,866 | A * | 2/1988 | McCauley | 404/25 |
| 4,883,626 | A * | 11/1989 | Weidman et al. | 264/156 |
| 6,379,196 | B1 * | 4/2002 | Greenberg et al. | 439/801 |
| 7,114,900 | B2 * | 10/2006 | Toosky | 411/108 |
| 2005/0196238 | A1 * | 9/2005 | DeGreef | 404/25 |
| 2006/0134999 | A1 * | 6/2006 | Tievant et al. | 439/709 |

FOREIGN PATENT DOCUMENTS

| | | | |
|---|---|---|---|
| BE | 1005975 | A6 * | 3/1994 |
| DE | 102004063054 | A1 * | 7/2009 |
| EP | 1845203 | A1 * | 4/2007 |
| EP | 1845203 | A1 * | 10/2007 |
| FR | EP 0533533 | A1 * | 8/1992 |
| GB | 2139673 | A * | 11/1984 |

* cited by examiner

*Primary Examiner*—Raymond W Addie
(74) *Attorney, Agent, or Firm*—Warner Norcross & Judd LLP

(57) ABSTRACT

A municipal casting frame is provided with cast nut retainers that allow the frame to be used with or without a bolt-down cover. The frame defines one or more bolt holes of sufficient dimension to allow free passage of the cover bolts. The undersurface of the frame defines a cast nut retainer adapted to securely receive a nut. In one embodiment, the nut retainer includes protrusions that permit the nut to be snap-fitted into the nut retainer. In another embodiment, the nut retainer is configured to frictionally receive the nut in a wedging interaction. The present invention also provides a method for manufacturing a frame with integral cast nut retainers. The method generally includes the steps of (a) providing a core corresponding in shape to the bolt hole and the cast nut retainer, the cast nut retainer being configured to receive and retain a nut, (b) casting a frame in a mold about the core, (c) removing the cast frame from the mold and (d) removing the core from the cast frame. The process may also include the step of inserting a nut into the cast nut retainer in a direction that is in substantial coaxial alignment with the bolt hole.

6 Claims, 8 Drawing Sheets

MUNICIPAL CASTING FRAME AND METHOD OF MANUFACTURING SAME

BACKGROUND OF THE INVENTION

The present invention relates to municipal castings and more particularly to municipal casting frames that support covers, and to method for manufacturing the same.

Municipal castings are a broad range of products used in conjunction with municipal and construction applications to enclose, trim and/or provide access to infrastructure, such as drainage and sewer infrastructure. Some of the most common municipal castings include manholes, covers and frames.

In many applications, municipal casting are used in connection with an access point to underlying infrastructure. For example, municipal casting may be used to provide a frame and cover over an access point to the infrastructure. Typically, the frame will be securely affixed to the infrastructure in an essentially permanent manner. The cover will be removably fitted to the frame to close the access opening.

If desired, a cover and frame may be configured to allow the cover to be bolted to the frame. This provides improved security and helps to avoid unauthorized and inadvertent removal of the cover from the frame. In conventional applications where a bolt-down cover is desired, a specially configured frame is installed. The frame is typically provided with lugs that are drilled and tapped to provide structure for threadedly receiving a bolt. The process of a preparing a frame for use in a bolt-down application adds additional cost. Accordingly, it is desirable to prepare a frame for bolts only when a bolt-down cover is expected. As a result, the majority of existing and new frame installations do not include a frame that is configured for a bolt-down cover.

It is not uncommon for a customer to request conversion of an installation from a standard cover to a bolt-down cover. If the installation includes a frame prepared for a bolt-down cover, the conversion process is simple and straightforward. However, if the installation does not include such a frame, it is necessary to either replace the frame or perform field modifications to the frame. Typical field modifications include drilling and tapping holes in the frame capable of receiving the cover bolts. In some applications, the frame may not be suitable for field modifications of this type. For example, the frame may not include a wide enough support flange to be drilled and tapped for this purpose. Further, with repeated use, threads can be damaged. If the threads become damaged, it may be necessary to replace the frame or to undergo even more extensive field modifications.

In an effort to facilitate the use of bolt-down covers, some existing frames include one or more nut shelves on the undersurface of the frame in alignment with the bolt holes. The nut shelves include a plurality of walls that define a nut compartment beneath each bolt hole. In use, a nut is slid sideways into the nut compartment. The nut shelf loosely holds the nut beneath the bolt hole and prevents it from rotating when a bolt is installed. Although an improvement in some respects, experience has revealed that it can be difficult to align the nut with the bolt hole and that the nut can move within the slot making it difficult to install the bolts.

SUMMARY OF THE INVENTION

The aforementioned problems are overcome by the present invention wherein a municipal casting frame is provided with cast nut retainers that allow the frame to be retrofitted with a bolt-down cover. The frame defines one or more bolt holes of sufficient dimension to allow free passage of the cover bolts.

The undersurface of the frame defines a cast nut retainer adapted to securely receive a nut.

In one embodiment, the nut retainer includes a plurality of beads that are spaced a sufficient distance to permit a nut to be forced into the nut retainer, but close enough so that the nut with not fall from the nut retainer once on place. In this embodiment, the spacing between the beads is slightly smaller than the width of the nut. According the nut can be pushed past the beads up into the nut retainer if sufficient force is applied. In this embodiment, the nut retainer may include defined a nut-shaped void and may include a single bead an each wall of the void. In this embodiment, the nut may be somewhat loosely held in the nut retainer so that the nut is able to move to facilitate alignment with the cover bolt.

In one embodiment, the nut retainer is configured to frictionally receive the nut in a wedge-like manner. In this embodiment, the retainer corresponds in shape to the nut and includes angled walls that exceed the dimensions of the nut at the retainer opening but are smaller than the dimensions of the nut at the retainer base. Accordingly, when a nut in inserted into the cast nut retainer, it becomes wedged in place in the frame so that bolts can be installed from above the cover.

In one embodiment, the frame includes one or more lugs that define the cast bolt hole and the cast nut retainer. The lugs may be positioned wherever a bolt is desired.

The present invention also provides a method for manufacturing a frame with integral cast nut retainers. The method generally includes the steps of (a) providing a mold for casting a frame, (b) providing a core corresponding in shape to the bolt hole and the cast nut retainer, (c) positioning the core within the mold at the desired location, (d) casting the frame in the mold about the core, (e) removing the cast frame from the mold and (f) removing the core from the cast frame. In one embodiment of this process, the core is configured to define a cast nut retainer that corresponds in shape with the nut and includes angled walls that exceed the dimensions of the nut at the retainer opening but are smaller than the dimensions of the nut at the retainer base. In this embodiment, the process may also include the step of inserting a nut into the cast nut retainer until the nut is firmly wedged in place.

The present invention provides an inexpensive and practical frame that can be used with or without a bolt-down cover. The bolt holes and nut retainers are formed as an integral part of the casting process. Accordingly, the present invention does not require drilling, tapping or other operations following casting. As a result, a frame can incorporate the present invention without adding significant cost. This permits the frame to be used in all application whether or not a bolt-down cover is anticipated. The initial installation may include a bolt-down cover or the installation can be easily retrofitted to include a bolt-down cover. The frame is retrofitted simply by seating a nut into each cast nut retainers, placing a bolt-down cover over the frame and installing bolts through the cover and bolt holes into the nuts. Unlike drilled and tapped arrangements, damage to the threads of the nut can be remedied simply by replacing the nut.

These and other objects, advantages, and features of the invention will be readily understood and appreciated by reference to the detailed description of the current embodiment and the drawings.

DESCRIPTION OF THE CURRENT EMBODIMENT

Figure 1:
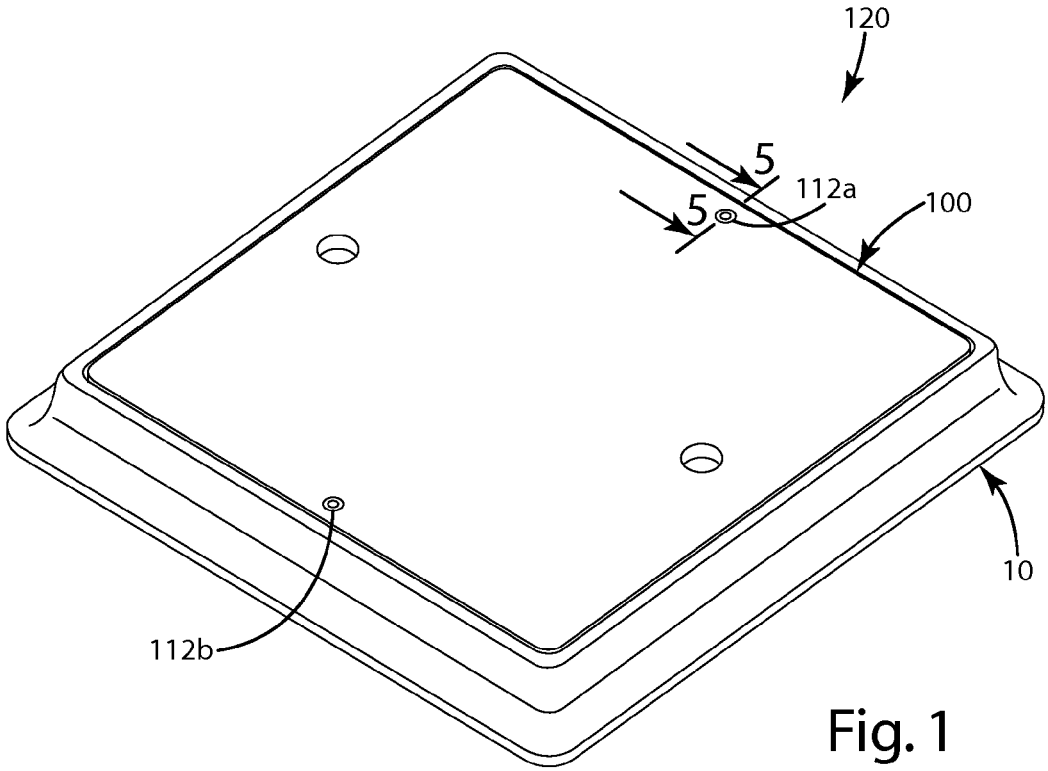
FIG. 1 is a perspective view of a manhole frame and cover installation in accordance with an embodiment of the present invention.
Figure 2:
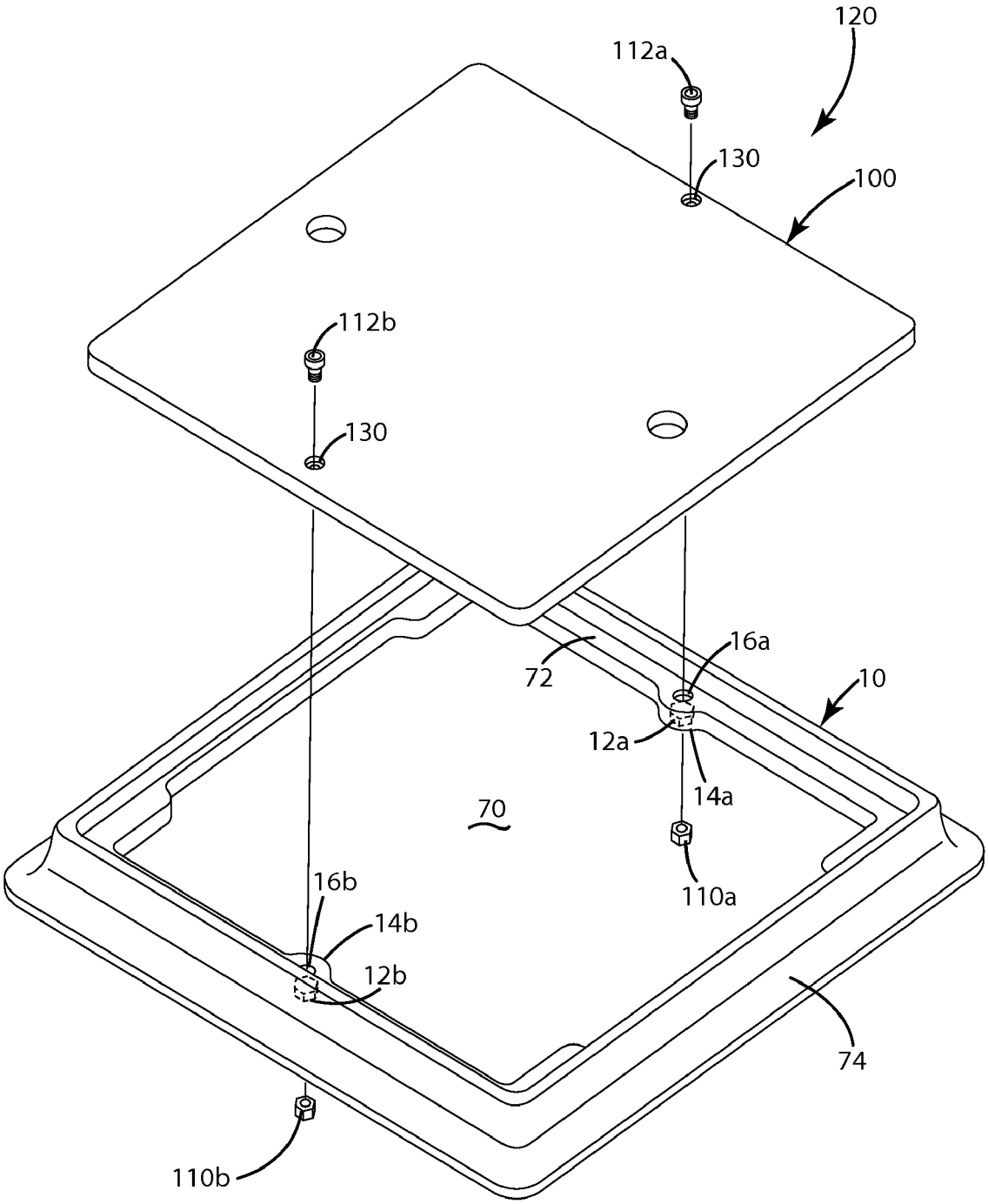
FIG. 2 is an exploded perspective view of the installation.
Figure 3:
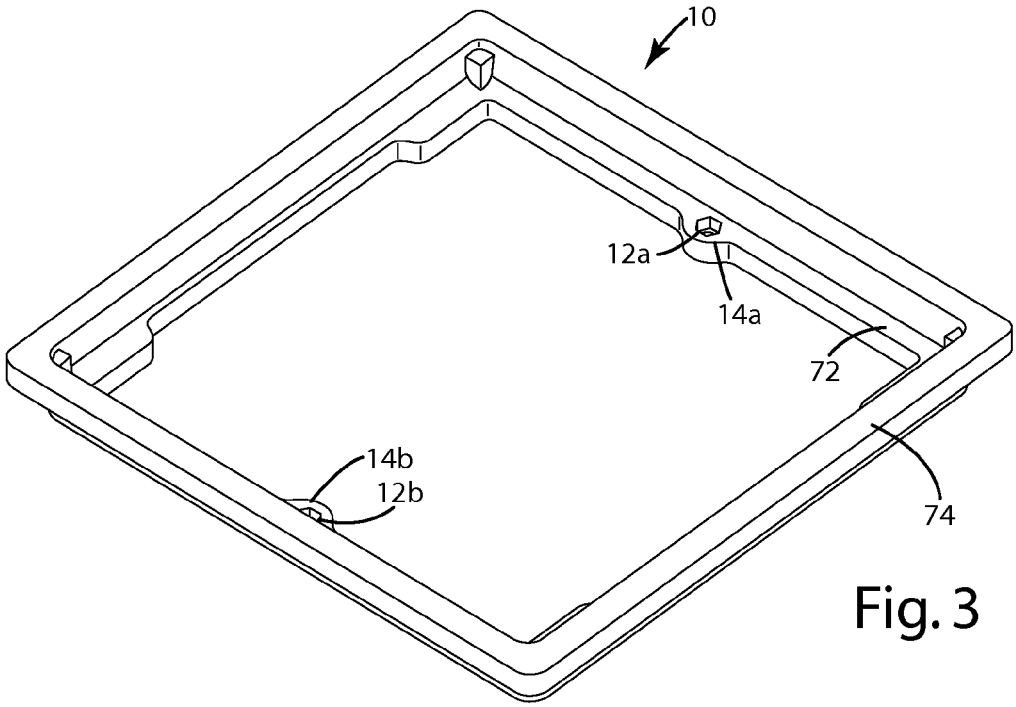
FIG. 3 is a bottom perspective view of the frame.

A municipal casting frame and cover installation 120 in accordance with an embodiment of the present invention is shown in FIG. 1. As perhaps best shown in FIG. 2, the installation 120 generally includes a frame 10 and a bolt-down cover 100. The frame 10 includes a plurality of cast nut retainers 12*a-b* that are configured to selectively hold nuts 110*a-b*. The nut retainers 12*a-b* are integrally cast into the frame 10. In use, nuts 110*a-b* can be fitted into the cast nut retainers 12*a-b* to receive cover bolts 112*a-b*. The present invention is described in connection with an otherwise conventional manhole assembly 120 having a frame 10 and cover 100. The present invention is, however, well suited for use in other types of municipal castings that include a cover.

The cover 100 is generally conventional and therefore will not be described in detail. Although the illustrated cover 100 is a bolt-down cover having bolt holes 130 configured to receive standard cover bolts 112*a-b*, the frame 10 can be utilized to support a standard cover (i.e. a non-bolted cover). When the frame 10 is to be used with a standard cover, it is not necessary to install the nuts 110*a-b*. In the illustrated embodiment, the nuts 110*a-b* are forcefully inserted into the nut retainers 12*a-b* until they are retained by interaction with nut retainers 12*a-b*, and the cover 100 is placed on the frame 10. The cover bolts 112*a-b* are fitted through bolt holes 130 in the cover 100 and are threadedly installed in the nuts 110*a-b*. In this way, the bolts 112*a-b* secure the cover 100 on the frame 10.

Figure 4:
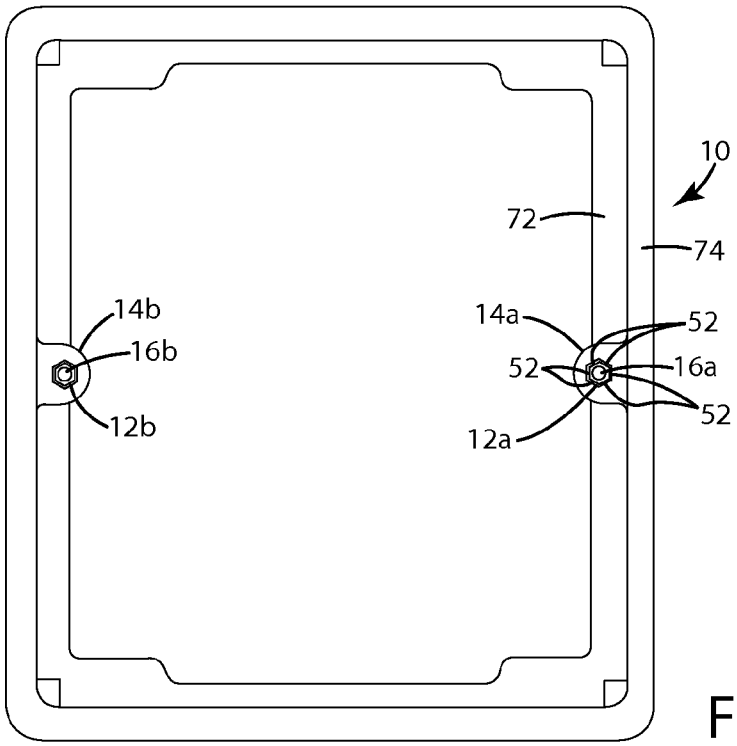
FIG. 4 is a bottom plan view of the frame absent the nuts.
Figure 5:
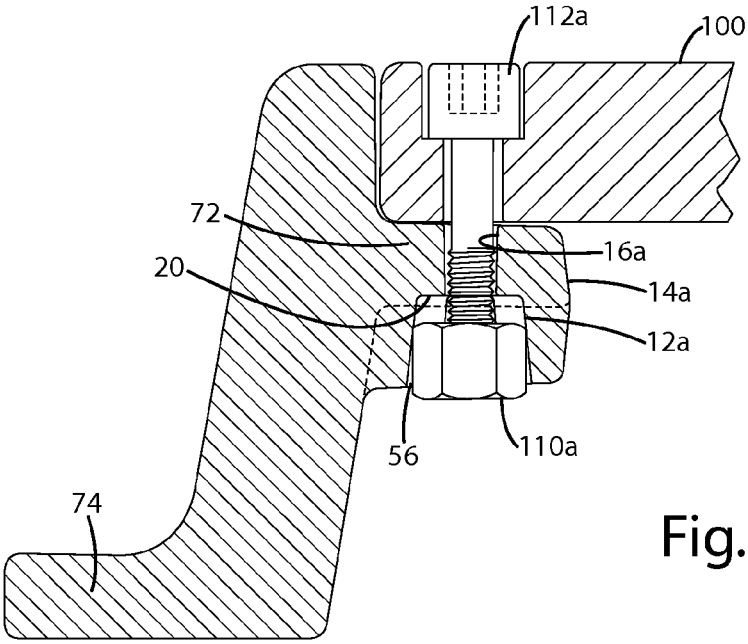
FIG. 5 is an enlarged partially sectional view of a portion of the installation.
Figure 6:
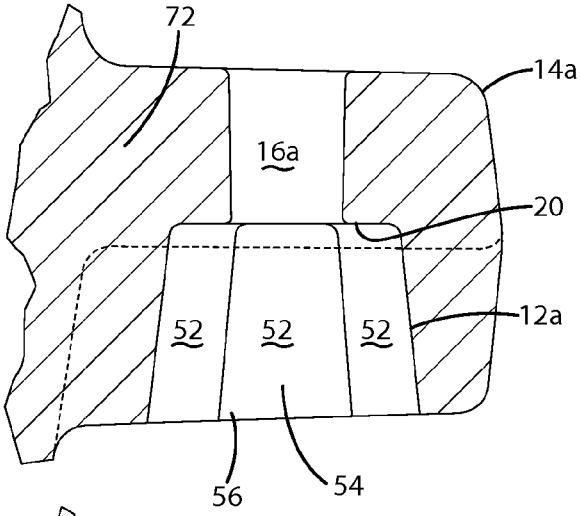
FIG. 6 is an enlarged section view of a portion of the frame.

In the illustrated embodiment, the frame 10 is generally peripheral structure defining a central opening 70. The frame 10 generally includes a flange 72 shaped to receive the cover 100 and a shoulder 74 shaped to rest on an underlying structural component. Although the frame 10 and cover 100 of this embodiment are generally square, the present invention can be easily incorporated into installations of other shapes, such as circular or rectangular installations. The frame 10 includes a plurality of lugs 14*a-b*, each defining a bolt hole 16*a-b* and a coaxial cast nut retainer 12*a-b*. The lugs 14*a-b* provide an enlarged region in the frame 10 having sufficient structural integrity to receive the bolts 112*a-b*. The size, shape, and configurations of the lugs 14*a-b* may vary from application to applications. The lugs 14*a-b* may be eliminated when the frame 10 is otherwise capable of defining the cast nut retainer and 12*a-b* and of bearing the forces associated with bolting down the cover 100. The cast nut retainers 12*a-b* are essentially identical to one another. Accordingly, only a single cast nut retainer 12*a* will be described in detail. Referring now to FIGS. 5 and 6, the cast nut retainer 12*a* is defined in lug 14*a*. In the illustrated embodiment, the nut retainer 12*a* is intended to receive a hexagon nut. As a result, the nut retainer 12*a* is a generally hexagon-shaped void 54 having a base 20 and a mouth 56. More specifically, as shown in FIG. 4, the illustrated nut retainer 12*a* includes six walls 52 arranged in a hexagon configuration. The nut retainer 12*a* need not fully correspond is shape with the nut 110*a* as long as it is capable of firmly seating and preventing rotation of the nut 110*a*. In the illustrated embodiment, the nut retainer 12*a* is configured to frictionally receive the nut 110*a*. In this embodiment, the walls 52 defining the nut retainer 12*a* are angled to provide a wedging interaction with the nut 110*a*. More specifically, the walls 52 are configured such that the nut retainer 12*a* is a larger than the dimensions of the nut 110*a* at its mouth 56, which permits the nut 110*a* to be inserted freely into the mouth 56 of the nut retainer 12*a*. However, the walls 52 are angled a sufficient amount so that the nut retainer 12*a* is smaller than the dimensions of the nut 110*a* at its base 20. As a result, continued insertion of the nut 110*a* into the nut retainer 110 beyond the mouth 56 causes the nut 110*a* to ultimately become wedged into the place within the nut retainer 12*a*. In the illustrated embodiment, the walls 52 are angled from mouth 56 to base 20. It is not strictly necessary for the angled walls 52 to be angled along there entire length or width. If desired, only a portion (or portions) of the angled walls 52 may be angled to provide the desired wedging interaction. Although all of the walls 52 are angled in the illustrated embodiment, the number of angled walls may vary from application to application. For example, in some applications only a single angled wall (or angled wall portion) may be necessary (not shown). As another alternative, the angled wall(s) of the nut retainer may be replaced by a nut with one or more angled walls (or angled wall portions)(not shown).

Figure 7:
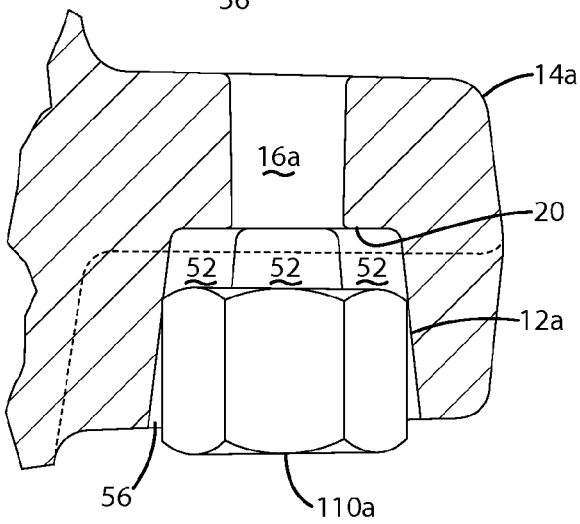
FIG. 7 is an enlarged section view of a portion of the frame showing the nut.

Referring now to FIGS. 4-6, the bolt hole 16*a* is coaxial with the nut retainer 12*a*. Accordingly, a bolt 112*a* extending through the bolt hole 16*a* with be aligned with the approximate center of the nut 110*a* (See FIG. 7). In the illustrated embodiment, the bolt hole 16*a* is generally circular having a diameter substantially greater then that of the bolt 112*a*. This permits the bolt 112*a* to pass freely through the hole 16 to engage the nut 110*a*. The bolt hole 16*a* need not, however, be circular and may have alternative shapes as desired. For example, the bolt hole 16*a* may be sufficiently larger than the diameter of the bolt 112*a* so that the bolt 112*a* can be moved as necessary to align with the nut 110*a*.

The frame 10 may be manufactured using conventional casting techniques and apparatus modified to provide for the nut retainers 12*a-b* of the present invention. For example, the frame 10 may be formed from iron using conventional casting techniques using a core configured to define the nut retainers 12*a-b*. The method includes the steps of (a) providing a pattern (not shown) corresponding in shape to the frame 10, (b) using the pattern to define a mold cavity (not shown) in the shape of the frame 10, which in this example includes lug portions (not shown) to define lugs 14*a-b*, (c) providing one or more cores (not shown) corresponding in shape to the bolt hole 16*a-b* and the cast nut retainer 12*a-b*, (d) positioning the cores within the mold cavity at the desired location, which in this embodiment are within the lug portions, (e) introducing molten material (e.g. iron) into the mold cavity, the molten material filling the mold cavity and at least partially surrounding the cores, (f) curing the molten material to form the cast frame, (g) removing the cast frame from the mold cavity, (h) removing the cores from the cast frame 10 to leave the bolt holes 16*a-b* and cast nut retainers 12*a-b*. In one embodiment, each core (not shown) includes a nut retainer portion to define the cast nut retainer 12*a-b* and a bolt hole portion to define the bolt hole 16*a-b*. The nut retainer portion and holt hole portion may be in coaxial alignment. In this embodiment, the nut retainer portion generally corresponds in shape with the nut 110*a* and includes at least one angled wall that exceeds the dimensions of the nut at one end but is smaller than the dimensions of the nut at the other end. Accordingly, the nut retainer portion defines a cast nut retainer 12*a-b* in the frame 10 that is capable of frictionally receiving the nut 110*a*. In this embodiment, the process of using the frame 10 may include the step of inserting a nut 110*a* into the cast nut retainer 12*a-b* until the nut 110*a* is firmly wedged in place. The nut 110*a* can be removed from the cast nut retainer 12*a-b* when desired, for example, if the threads become damaged.

Figure 8:
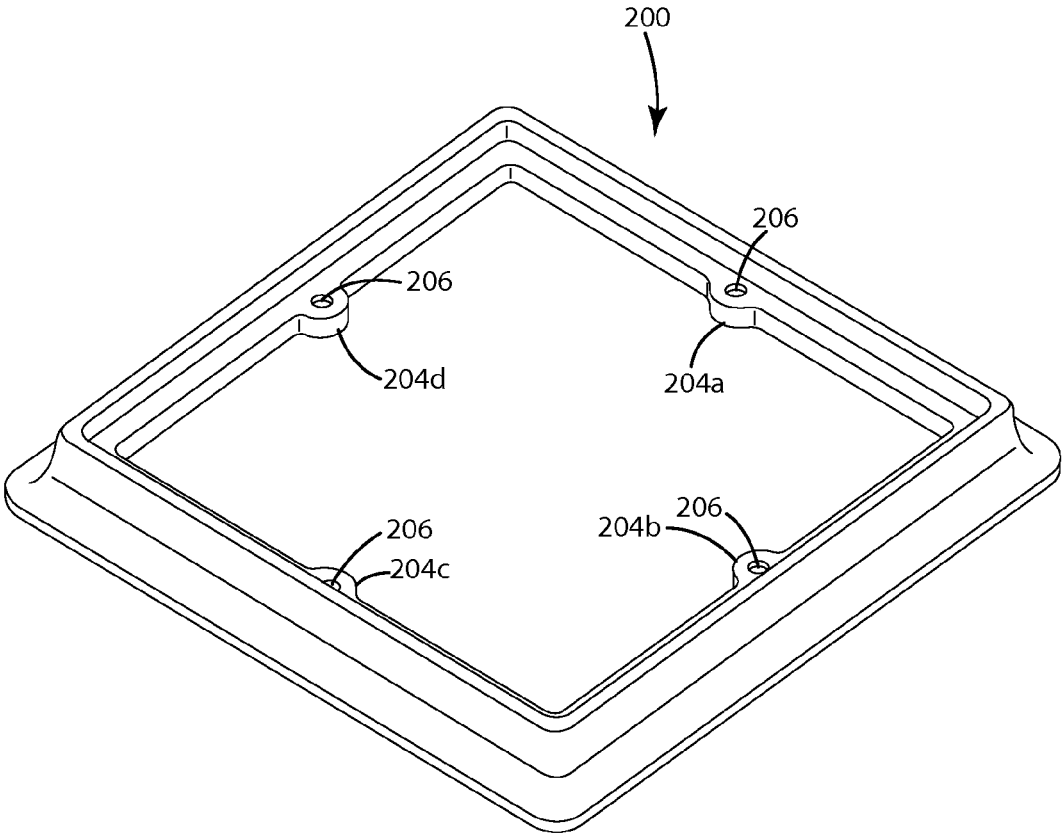
FIG. 8 is a perspective view of an alternative frame having four lugs.

In the illustrated embodiment, the frame 10 and cover 100 include two bolts 112*a-b* that are intended primary for security (e.g. to deter unauthorized removal of the cover 100). The number of bolts may, however, vary from application to application as desired. For example, the installation may include three or four bolts, which will typically be spaced evenly around the frame and cover. The present invention may be incorporated into watertight applications. In watertight applications (not shown), a gasket may be fitted between the frame and cover and a rubber washer may be fitted over each bolt. Installation of this type are likely to include three, four or more bolts. For example, FIG. 8 shows an alternative frame 200 that is intended to receive up to four bolts (not shown). As shown, frame 200 includes four lugs 204*a-b*. Each of these lugs 204*a-b* defines a bolt hole 206 and a nut retainer (not visible), which may essentially identical to the bolt holes 14*a-b* and nut retainers 12*a-b* described above or those described below.

Figure 9:
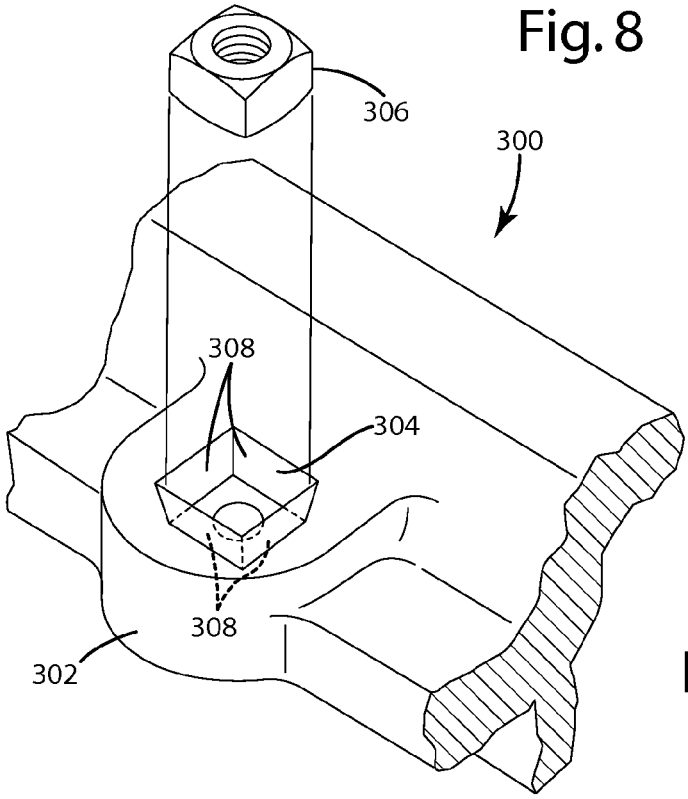
FIG. 9 is an exploded perspective view of a portion of another alternative embodiment having a square nut.

The present invention is described above in connection with a hexagon shaped nut 110*a*. The present invention may alternatively be confirmed for use with nuts having other shapes. For example, FIG. 9 shows a portion of an alternative embodiment 300 having a lug 302 with a nut retainer 304 shaped to receive a square nut 306. As in the above illustrated embodiment, nut retainer 304 includes at least one angled wall 308 that permits the nut 306 to be wedged into place with in the nut retainer 304.

Figure 10:
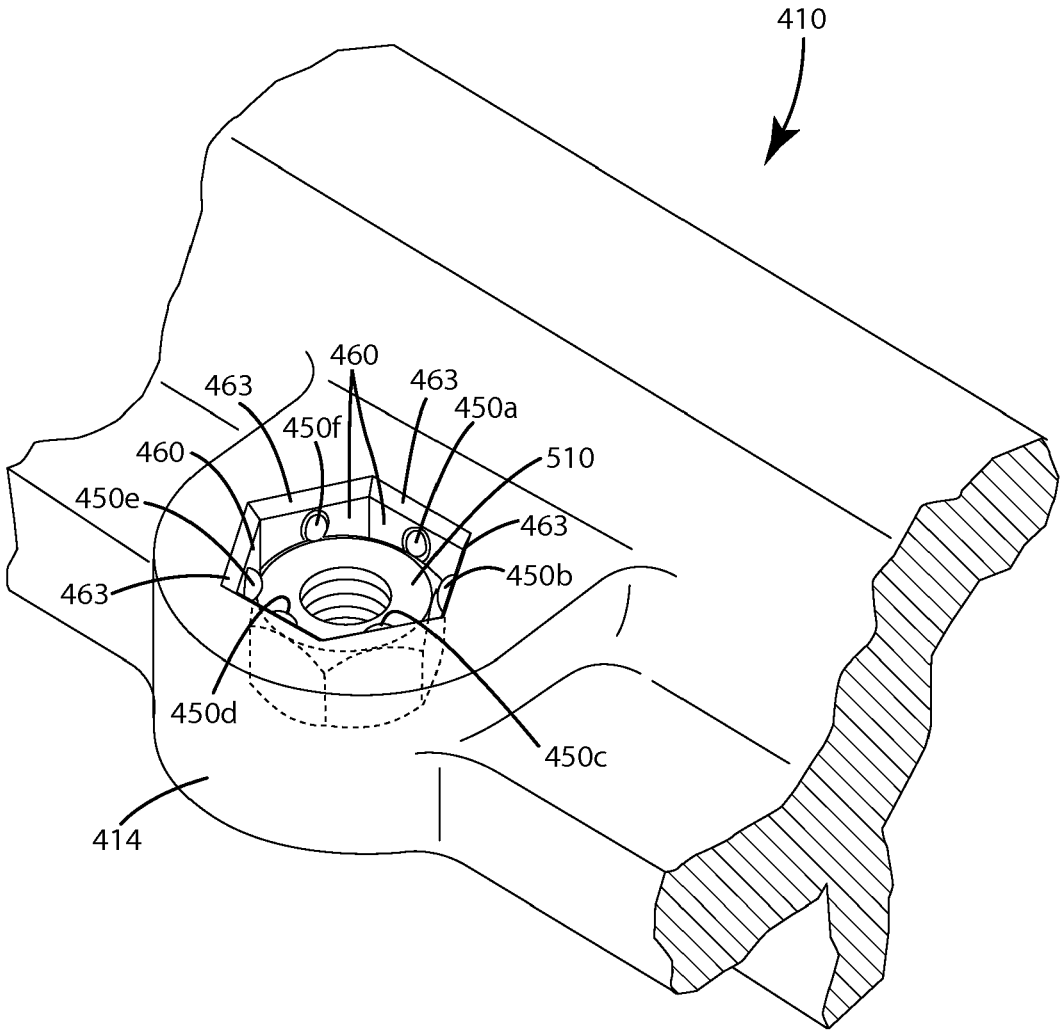
FIG. 10 is a perspective view of a portion of the frame of another alternative embodiment.
Figure 11:
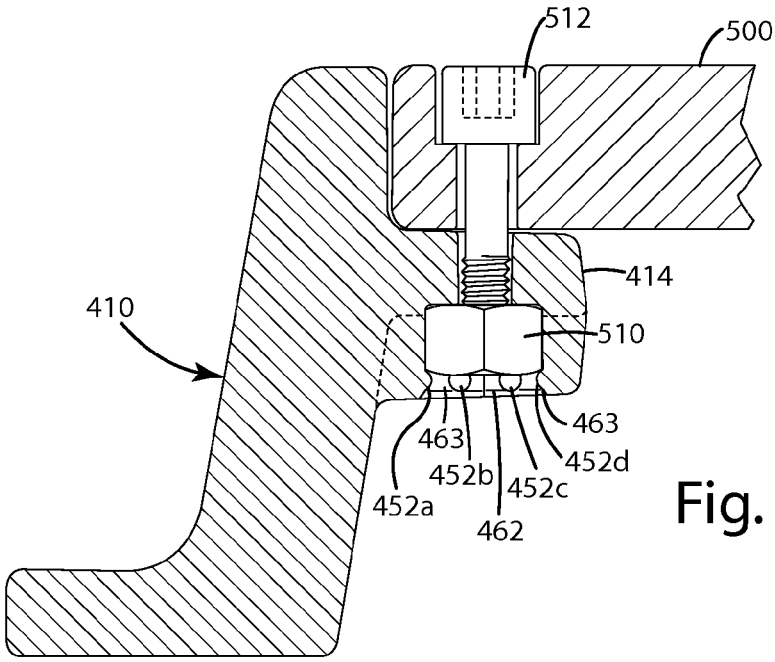
FIG. 11 is a partially sectional view of a portion of the alternative embodiment of FIG. 10.
Figure 12:
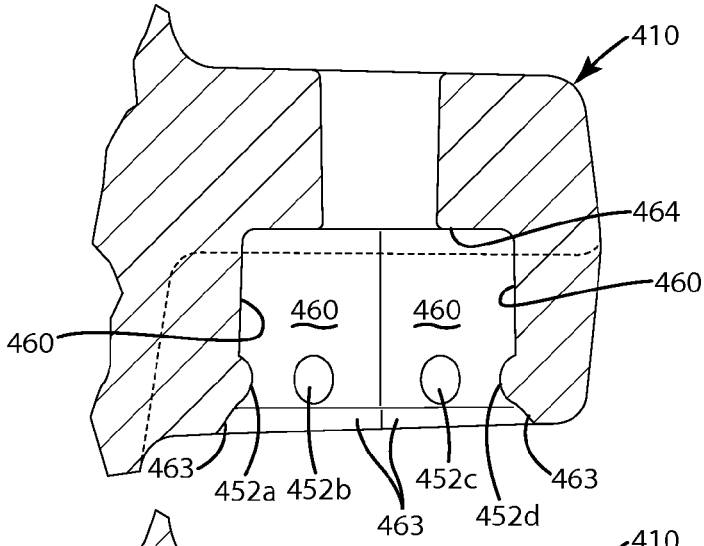
FIG. 12 is a sectional view of a portion of the frame of the alternative embodiment of FIG. 10.
Figure 13:
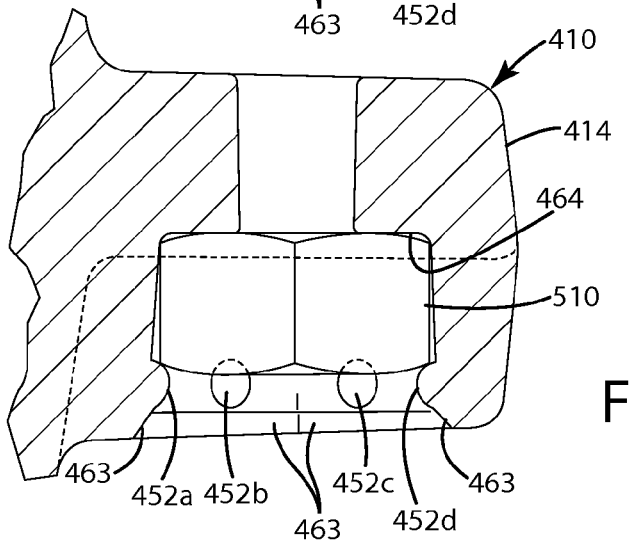
FIG. 13 is a sectional view of a portion of the frame of the alternative embodiment of FIG. 10 with a nut contained in the nut retainer.

Another alternative embodiment of the invention is shown in FIGS. 10-13. In this embodiment, the wedge-type nut retainer is replaced by a snap-type nut retainer. Except as otherwise described, the frame 410 and cover 500 of FIGS. 10-13 are essentially identical to frame 10 and cover 100. FIG. 10 shows a bottom perspective of a portion of the frame 410 including a single lug 414 and associated nut retainer 412. The frame 410 may include essentially any desired number of lugs 414 and nut retainers 412 spaced as desired about the frame 410. As shown, the nut retainer 412 includes six walls 460 arranged in a hexagon shape to receive a hexagon nut 510. The number and configuration of walls may vary from application to application. The nut retainer 412 also includes a plurality of beads 450*a-f* positioned around the nut retainer 412 near the mouth 462. In this embodiment, the beads 450*a-f* are generally semispherical, but the shape of the beads may vary from application to application. Although the nut retainer 412 is shown with a bead 450*a-f* on each wall 460, the number of beads may vary from application to application. For example, in some applications only a pair of beads positioned on opposing walls may be used. Further, the beads may be replaced by other types of protrusions capable of receiving a nut in a snap-like manner. To provide an installed nut 510 with some movement, the walls 460 of the void 454 may be confirmed to be slightly larger than the nut 510 in one or more directions. This difference in size will allow a limited amount of movement of the nut 510 within the nut retainer 412 to facilitate alignment of the nut 510 with the cover bolt 512. As perhaps best shown in FIGS. 11 and 13, the beads 450*a-f* of the illustrated alternative embodiment are positioned to hold the nut 510 in relatively close contact with the base 464 of the nut retainer 412. If desired, the beads 450*a-f* may be spaced farther away from the base 464 to provide the nut 510 with movement in the vertical direction. For example, the beads 450*a-f* may be lowered one millimeter to reduce the likelihood of problems associated with imperfections in the base 464 and/or to give the nut 510 a limited ability to cant within the nut retainer 412 to facilitate alignment with the cover bolt 512. In this embodiment, the mouth 462 is defined by a plurality of angles walls 463. The angled walls 463 facilitate insertion of the nut 510 into the nut retainer 412 by guiding the nut 510 into the center or the nut retainer 412. In the illustrated embodiment, the walls 463 of the mouth 462 are angled at approximately 45 degrees with respect to the axis of the nut retainer 412, but the angle of the walls may vary from application to application as desired.

Figure 14:
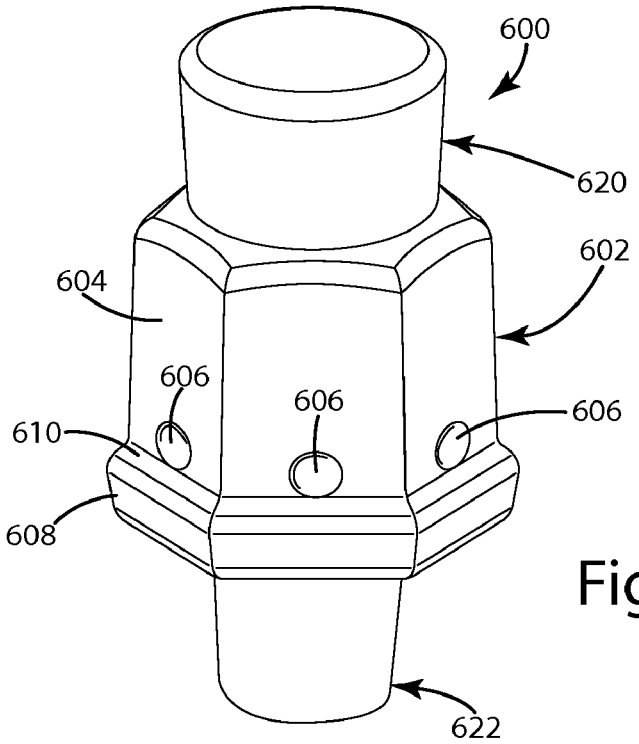
FIG. 14 is a perspective view of a core used to form the nut retainer of FIGS. 10-13.
Figure 15:
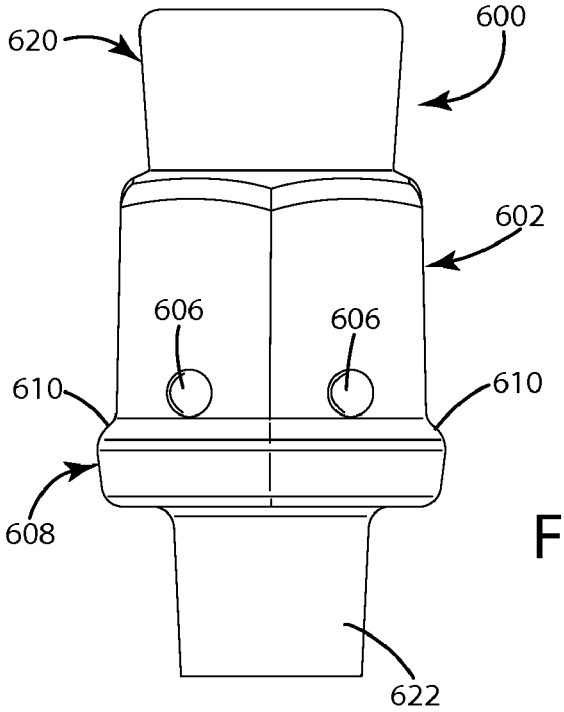
FIG. 15 is a front elevational view of the core.

This alternative frame 410 may be manufactured using the methods described above in connection with frame 10 using cores (See FIGS. 14 and 15) configured to define the beads 450*a-f* or other desired protrusions. A single core 600 is shown in FIGS. 14 and 15. Separate cores 600 may be inserted into the mold cavity (not shown) at each of the locations where a nut retainer 412 is desired. The core 600 generally includes an upper segment 620, a lower segment 622 and a central segment 602. The upper segment 620 and lower segment 622 assist in securing the core 600 in place within the mold cavity (not shown). The central segment 602 defines the nut retainer 412 and is accordingly formed in the reverse of desired shape of the nut retainer 412. The central segment 602 generally includes a head portion 604 that defines the main void of the nut retainer 412 and a shoulder portion 608 that defines the mouth of the nut retainer 412. The head portion 604 and shoulder portion 608 that defines of this embodiment are hexagon shaped to correspond with hexagon nut 510. A plurality of indentations 606 are defined in the head portion 604. The indentations 606 define the beads 450*a-f* and, as show, are positioned adjacent to the shoulder portion 608 in this embodiment. The shoulder portion 608 includes angled surfaces 610 that, as noted above, create an angled entry (or mouth 462) that, in turn, facilitates insertion of the nut 510 into the nut retainer 412. The core 600 is removed from the cast frame 410 after casting in a conventional manner.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be considered as limiting the element to the singular.

The invention claimed is:

1. A method for manufacturing a frame for use in municipal castings, comprising the steps of:

defining a mold cavity in a shape of the frame;

providing a core having a shape corresponding to a desired shape of a bolt hole and a nut retainer, the core having a bolt hole portion and a nut retainer portion, the nut retainer portion configured to define a void shaped to receive the nut and to prevent rotation of the nut, the void having a mouth through which the nut is inserted into the void, the nut retainer portion configured to define a protrusion extending into the void adjacent the mouth, the protrusion retaining the nut within the void and preventing substantial movement of said nut in the direction away from said bolt hole portion;

inserting the core into the mold cavity;

introducing frame material into the mold cavity;

allowing the frame material to cure into a cast frame;

removing the cast frame from the mold cavity; and removing the core from the cast frame, the core leaving a cast bolt hole and a cast nut retainer in the frame.

2. The method of claim 1 wherein said providing step is further defined as:

providing a core having a shape corresponding to a desired shape of a bolt hole and a nut retainer, the core having a bolt hole portion and a nut retainer portion, the nut retainer portion configured to frictionally receive a nut, the nut retainer having a shape generally corresponding with that of the nut, the nut retainer having a first end with dimensions greater than the dimensions of the nut and a second end with dimensions smaller that the dimensions of the nut.

3. The method of claim 1 wherein said providing step is further defined as:

providing a core having a shape corresponding to a desired shape of a bolt hole and a nut retainer, the core having a bolt hole portion and a nut retainer portion, the nut retainer portion configured to define a void having a plurality of walls, the void shaped to receive the nut and to prevent rotation of the nut, the void having a mouth through which the nut is inserted into the void, the nut retainer portion configured to define a protrusion extending into the void from each of the plurality of walls at a location adjacent to the mouth, the protrusions being configured to interfere with, but not prevent, insertion of the nut into the void and to cooperatively retain the nut within the void after the nut has been inserted into the void.

4. The method of claim 3 wherein said defining step is further defined as defining a mold cavity in a shape of the frame with at least one lug portion to provide the frame with at least one lug; and wherein said inserting step is further defined as inserting the core into the mold cavity within the lug portion, whereby the bolt hole and the nut retainer are defined in the lug.

5. The method of claim 4 further including the step of inserting a nut into the nut retainer in a direction in substantial coaxial alignment with the bolt hole.

6. The method of claim 5 where the mouth is defined by one or more angled surfaces, the one or more angled surfaces assisting in centering the nut upon insertion into the nut retainer.

* * * * *